US007150607B2

(12) United States Patent
Pelmulder et al.

(10) Patent No.: US 7,150,607 B2
(45) Date of Patent: Dec. 19, 2006

(54) UNIFORM FLOW DISPLACEMENT PUMP

(75) Inventors: John P. Pelmulder, Chatsworth, CA (US); Conrad O. Diaz, Canoga Park, CA (US)

(73) Assignee: International Remote Imaging Systems, Inc., Chatsworth, CA (US)

( * ) Notice: Subject to any disclaimer, the term of this patent is extended or adjusted under 35 U.S.C. 154(b) by 24 days.

(21) Appl. No.: 10/696,804

(22) Filed: Oct. 29, 2003

(65) Prior Publication Data

US 2004/0096347 A1 May 20, 2004

Related U.S. Application Data

(60) Provisional application No. 60/427,468, filed on Nov. 18, 2002.

(51) Int. Cl.
*F04B 43/12* (2006.01)

(52) U.S. Cl. ..... 417/477.2; 417/477.7; 417/477.12

(58) Field of Classification Search ..... 417/476, 417/477.2, 477.7, 477.9, 477.12, 477.14
See application file for complete search history.

(56) References Cited

U.S. PATENT DOCUMENTS

| | | | | |
|---|---|---|---|---|
| 2,693,766 | A * | 11/1954 | Seyler | 417/477.7 |
| 2,899,906 | A * | 8/1959 | Becher et al. | 417/477.12 |
| 2,977,890 | A | 4/1961 | Seyler | |
| 3,192,863 | A * | 7/1965 | Vadot | 417/477.7 |
| 3,565,554 | A * | 2/1971 | Muller | 417/477.12 |
| 3,724,974 | A | 4/1973 | Molimard | |
| 3,930,761 | A * | 1/1976 | Barraclough | 417/476 |
| 4,338,024 | A | 7/1982 | Bolz et al. | |
| 4,393,466 | A | 7/1983 | Deindoerfer et al. | |
| 5,620,312 | A * | 4/1997 | Hyman et al. | 417/477.2 |
| 5,938,414 | A * | 8/1999 | Kayahara et al. | 417/476 |
| 6,184,978 | B1 | 2/2001 | Kasdan et al. | |
| 6,473,172 | B1 | 10/2002 | Pelmulder | |
| 2002/0131881 | A1 | 9/2002 | Kagawa et al. | |

FOREIGN PATENT DOCUMENTS

| | | |
|---|---|---|
| GB | 2076476 | 12/1981 |
| JP | 57-24482 | 2/1982 |

* cited by examiner

*Primary Examiner*—Michael Koczo, Jr.
(74) *Attorney, Agent, or Firm*—DLA Piper US LLP

(57) ABSTRACT

A displacement pump comprising a pump assembly and a cassette assembly. The pump assembly includes upper and lower housing portions that define a cavity, an arm disposed in the cavity, a roller attached to the distal end of the arm, and a motor attached to the proximal end of the arm for rotating the arm. The cassette assembly is removably disposed in the cavity and comprises upper and lower cassette housing portions that form an annular compression surface with a channel therein. A hollow compression tube having a flange extending along a length thereof is secured to the compression surface by the flange being engaged with the channel. As the motor rotates the roller arm, the roller presses the compression tube against the compression surface to create a moving occlusion of the compression tube for pushing fluid through the compression tube.

3 Claims, 4 Drawing Sheets

UNIFORM FLOW DISPLACEMENT PUMP

This application claims the benefit of U.S. Provisional Application No. 60/427,468, filed Nov. 18, 2002.

FIELD OF THE INVENTION

The present invention relates to methods and systems for analyzing particles in a dilute fluid sample, and more particularly to pumps utilized by such systems to manipulate the fluid samples.

BACKGROUND OF THE INVENTION

Methods and systems for analyzing particles and particularly sediments are well known in the art, as disclosed in U.S. Pat. Nos. 4,338,024 and 4,393,466, which are incorporated herein by reference. Such systems utilize a flow cell though which fluid samples are passed, and a particle analyzer for capturing still frame images of the fluid passing through the flow cell. Thus, the flow cell positions and presents the sample fluid containing particles of interest for analysis. The more accurately that the sample fluid is positioned by flow cell, the better the analysis of the particles therein that can be made.

Typical flow cells cause the sample fluid, and a sheath fluid that buffers the sample fluid, to flow together from a large entry chamber into a small cross sectional examination area or region. The transition from the inlet or entry chambers to the examination region forms a hydrodynamic lens that squeezes both the sample fluid and the sheath fluid proportionally into the smaller space. Where the particles of interest are microscopic particles, the resulting cross-sectional space occupied by the sample fluid must be positioned within the depth of field of the analyzer, such as an optical system or a laser system, to obtain the best analytical information. For the best hydrodynamic focus, a large area of sheath flow must envelop the small area of sample fluid without any swirling or vortices. Thus, uniform flow of sample and sheath fluids through the flow cell is essential for optimal operation of particle analyzers.

Displacement pumps, (e.g. tubing or peristaltic pumps), are well known in the art and have been used to pump fluid samples and sheath fluids through flow cells. Conventional peristaltic pumps include multiple rollers that roll along flexible tubing containing fluid. The rollers push the fluid along the length of the tubing, drawing fluid into an input end of the tubing and forcing fluid out an output end of the tubing. A common configuration includes a rotating hub with rollers on its periphery, and an annularly shaped housing against which the tubing is pressed. With each rotation of the hub, each roller engages with, rolls along the length of, and disengages from, the tubing. At least one of the rollers is in contact with the tubing at all times so that fluid cannot flow backwards through the tubing.

Conventional peristaltic pumps have several drawbacks. For example, multiple rollers engaging with and disengaging from the flexible tube cause pulsations in the fluid flow through the pump, which can be problematic for proper operation of flow cells. Moreover, the amount of fluid delivered by the pump for n degrees of rotation is dependent on the starting angle of the rollers. Most pump designs only retain the tube at its ends, relying on the multiple rollers engaged with tubing to hold it in its circular path along the housing. Thus, the tube can stretch and contract as the rollers move across its length, which again can cause varying flow and uncertainty in the volume moved by rollers. Lastly, when the pump is shut down, rollers are left in contact with the tube, causing compression setting (flat spotting) of the tube, which adversely affects the uniform flow of the fluid after the pump is activated again.

There is a need for a displacement pump that provides uniform fluid flow of known and repeatable quantities, and which does not produce flat spots on the tube during non use.

SUMMARY OF THE INVENTION

The present invention is a pump that includes a compression surface, a hollow compression tube secured to the compression surface, and compression means for incrementally compressing the compression tube against the compression surface to create a moving occlusion of the compression tube that uniformly pushes fluid through the compression tube, wherein the compression means has at least one rest position in which the compression means does not compress the compression tube.

In another aspect of the present invention, a pump includes a pump assembly and a cassette assembly. The pump assembly includes a pump housing that defines a cavity, a roller disposed in the cavity, and a motor for moving the roller relative to the housing. The cassette assembly is removably disposed in the cavity and includes a cassette housing having a compression surface, and a hollow compression tube secured to the compression surface. As the motor moves the roller, the roller presses the compression tube against the compression surface to create a moving occlusion of the compression tube for pushing fluid through the compression tube.

Other objects and features of the present invention will become apparent by a review of the specification, claims and appended figures.

DETAILED DESCRIPTION OF THE PREFERRED EMBODIMENTS

The uniform displacement pump of the present invention is illustrated in FIGS. 1A–1B and 2A–2C, and includes a pump assembly 10 and a cassette assembly 12.

Figure 1A:
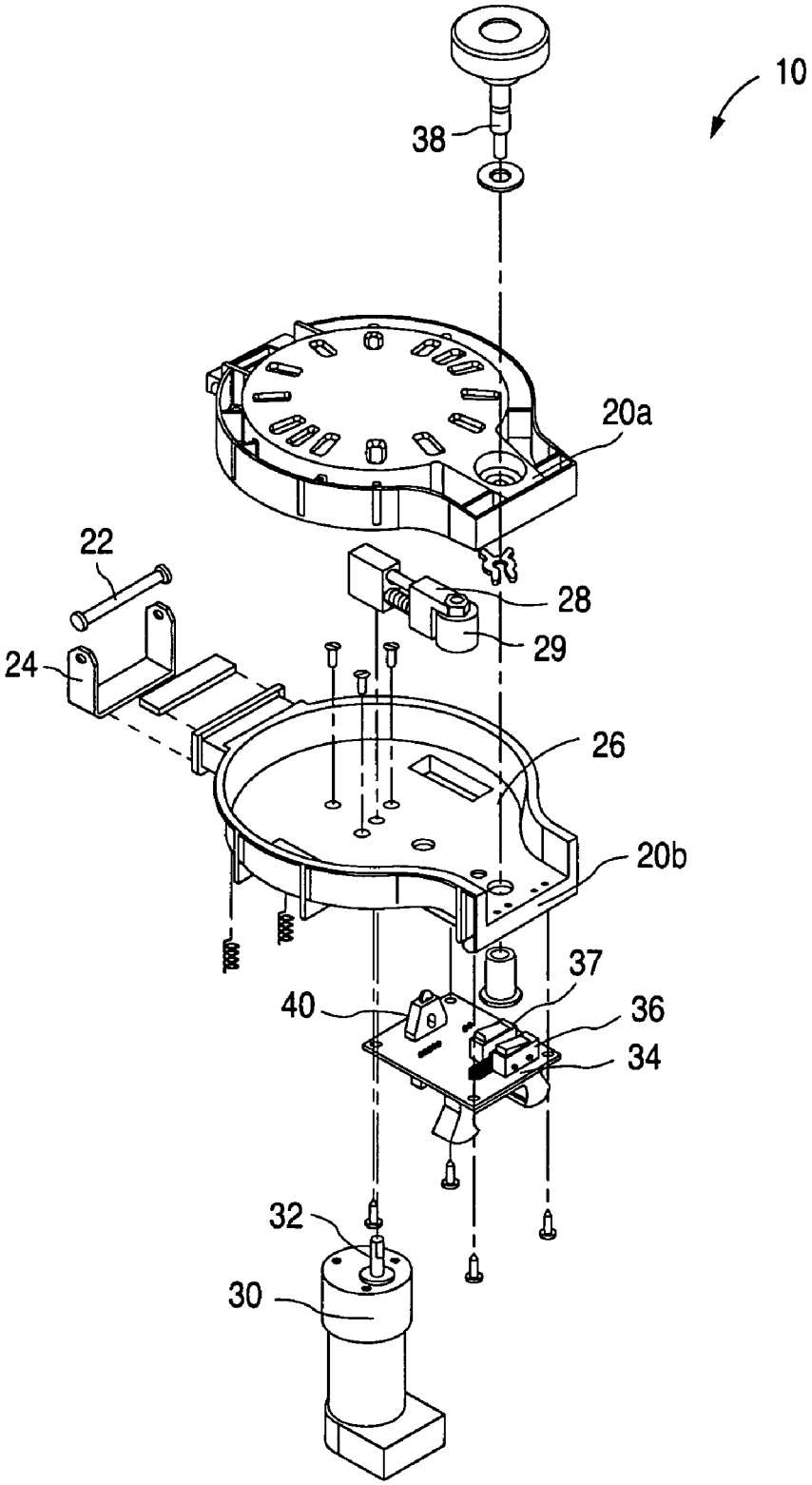
FIG. 1A is an exploded view of the pump assembly of the present invention.
Figure 1B:
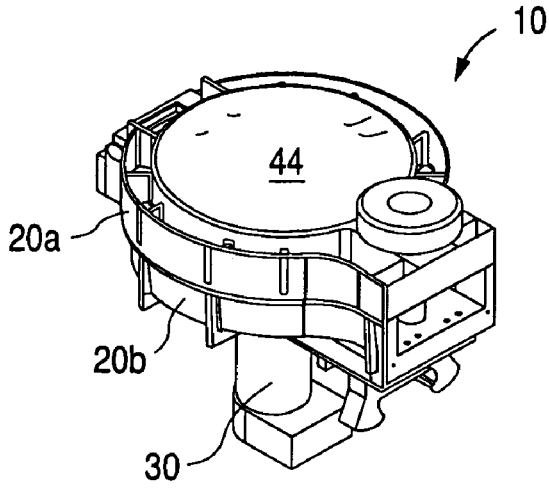
FIG. 1B is a perspective view of the pump assembly of the present invention.

FIGS. 1A–1B illustrate the pump assembly 10, which includes a housing having upper and lower housing portions 20*a*/20*b* respectively, that are hingedly attached to each other by a hinge 22 and hinge bracket 24. When upper housing 20*a* is closed over lower housing 20*b*, an annular cavity 26 is defined thereby. A roller arm 28, which is preferably spring loaded, is disposed in the cavity 26. Roller arm 28 has a proximal end at the center of the cavity 26, and a distal end with an outwardly facing compression roller 29 mounted thereon. A motor 30 has a drive shaft 32 that extends into the cavity 26 and is attached to the proximal end of the roller arm 28, for rotating the roller 29 around the periphery of the cavity 26. A sensor assembly 34 is mounted to the lower housing 20*b* and includes a sensor switch 36 for detecting a closure pin 38 from the upper housing 20*a*, indicating that the upper housing 20*a* is in a closed position over lower housing 20*b*. Sensor assembly 34 also includes a sensor switch 37 that detects the presence of the cassette assembly 12 in cavity 26, and a sensor 40 that detects and verifies the position of the roller arm 28.

Figure 2A:
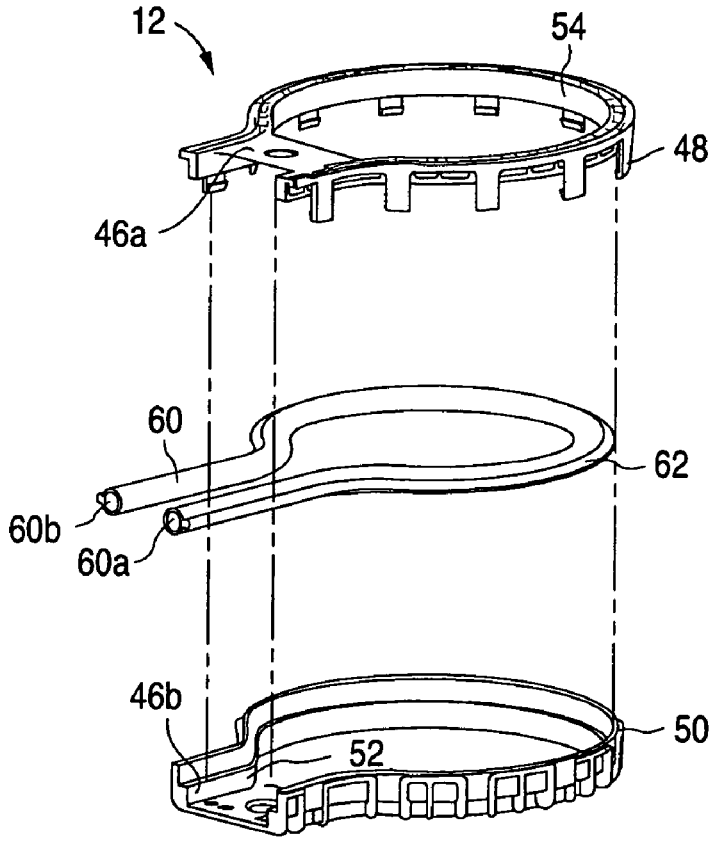
FIG. 2A is an exploded view of the cassette assembly of the present invention.
Figure 2B:
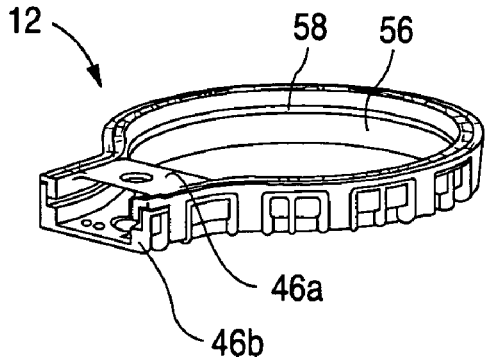
FIG. 2B is a perspective view of the cassette assembly (without compression tube) of the present invention.
Figure 2C:
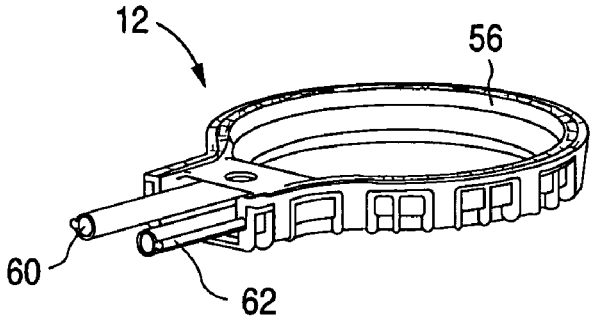
FIG. 2C is a perspective view of the cassette assembly of the present invention.

FIGS. 2A–2C illustrate the cassette assembly 12, which includes a housing having upper and lower cassette housing portions 46*a*/46*b* respectively, that snap together via engagement tabs 48 that extend from the upper cassette housing 46*a* and engage with lower cassette housing 46*b*. Lower cassette housing 46*b* includes an annular sidewall 50 with a shoulder 52 extending from an inner surface of the sidewall 50. Upper cassette housing 46*a* includes an annular sidewall 54. When upper/lower cassette housings 46*a*/46*b* are snapped together, upper cassette sidewall 54 fits inside lower cassette sidewall 50, where sidewall 54 and the shoulder portion of sidewall 50 together define an inwardly facing annular compression surface 56. Upper cassette sidewall 54 is positioned a fixed distance away from shoulder 52 to define a channel 58 in the annular compression surface 56.

A hollow compression tube 60 is removably disposed along the compression surface 56. The compression tube 60 includes a flange 62 adhered thereto or integrally formed therewith. The flange 62 snuggly inserts into channel 58 with a friction fit that evenly secures compression tube 60 against compression surface 56. Preferably, flange 62 is a solid cylindrically-shaped member that is integrally formed as part of the compression tube 60, and that has a thickness corresponding to the width of channel 58. The compression tube 60 has an input end 60*a* and an output end 60*b*.

To assemble pump 1, upper and lower cassette housings 46*a*/46*b* are snapped together, with a compression tube 60 secured against compression surface 56 via flange 62 (held in channel 58). The upper pump housing 20*a* is rotated open (away from lower pump housing 20*b*), and the cassette assembly 14 is inserted in lower pump housing 20*b*. The upper pump housing 20*a* is then closed, securely holding cassette assembly 12 in cavity 26.

When motor 30 is activated, roller arm 28 rotates within the cavity 26, so that roller 29 engages with compression tube 60 and compresses it against compression surface 56. The spring loaded roller arm 28 ensures that roller 29 is compressed against compression tube 60 with the desired amount of force, so that roller 29 creates an occlusion in the compression tube 60 which moves along the length of tube 60 as roller arm 28 makes a single revolution within cavity 26. The moving tube occlusion pushes a known quantity of fluid through the compression tube 60 in a uniform manner. By the time the roller arm 28 completes its single revolution, the roller 29 has moved along the entire length of the compression tube portion that is disposed on compression surface 56, and has disengaged from compression tube 60. The pump shown in the figures occludes the compression tube during (or for) 285 degrees of the rotation of roller arm 28, leaving 75 degrees of rotation where the roller 29 does not compress tube 60.

Ideally, the diameter of the compression tube 60 is selected so that the desired amount of fluid for a single process step (e.g. collection of images via a flow cell) can be produced by a single revolution of the roller arm 28, thus avoiding any pulsations caused by the repeated engagement and disengagement of the roller 29 with compression tube 60. By continuously anchoring the compression tube 60 against the compression surface (i.e. using the continuous flange 62 engaged in the continuous channel 58), tube squirm and fluid flow variations caused therefrom are avoided. A uniform delivery of fluid volume results from each incremental degree of rotation of roller arm 28. When the pump is inactive, the roller 29 is preferably parked in a default or rest position shown in FIG. 1A, where the roller 29 does not contact the compression tube 60, thus preventing premature tube failure due to the formation of flat spots therein. However, roller 29 can be temporarily parked on compression tube 60 so that the (stalled) tube occlusion acts as a temporary pinch-valve for the fluid inside compression tube 60.

The removable cassette 12 allows for easy replacement of the compression tubing 60 by the user. Insertion of the flange 62 into channel 58 is convenient and provides a repeatable positioning of the tubing 60 against compression surface 56. The tubing 60, and/or the cassette assembly 12 in its entirety, can be replaced by the user as tube 60 ages, ideally without the use of any tools. Closing upper housing 20*a* onto lower housing 20*b* compresses the cassette assembly 12 to secure compression tubing 60 and compression surface 56 in place (relative to pump assembly 10 and in particular roller 29). The clamping features of both the cassette assembly 12 and pump assembly 10 provide repeatable and convenient assembly and performance of the pump. The pump preferably uses tubing 60 having a symmetrical cross-section, which permits more uniform fabrication of the tubing and more repeatable pump performance, and is ideal for clamping features of the cassette assembly 12.

Figure 3:
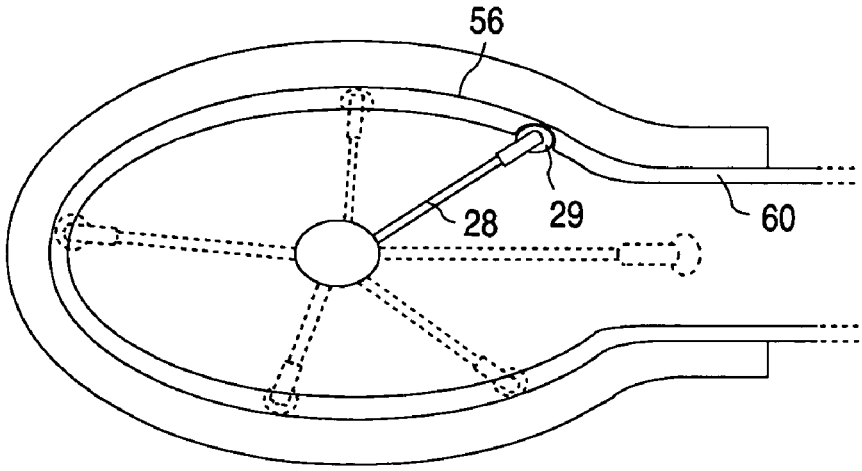
FIG. 3 is a top view of an alternate embodiment of the present invention.
Figure 4:
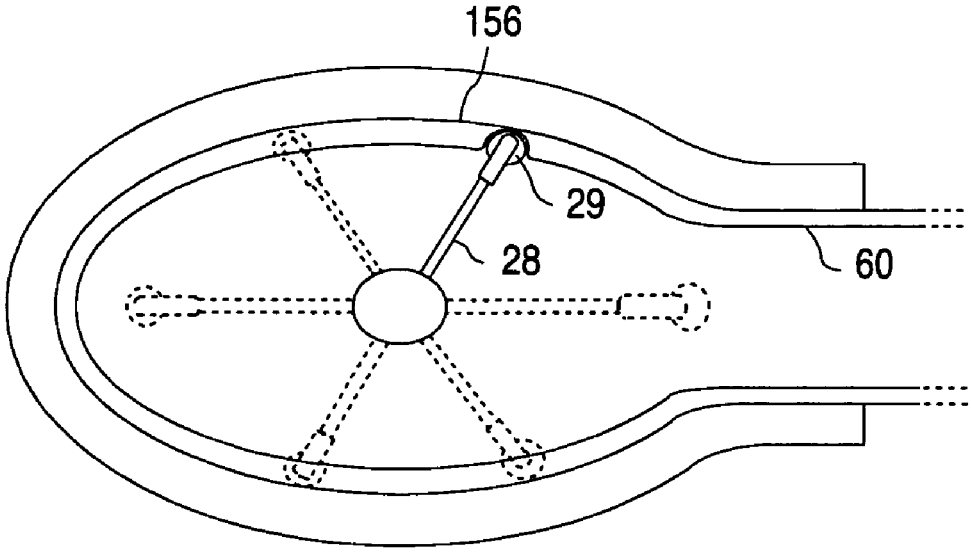
FIG. 4 is a top view of a second alternate embodiment of the present invention.
Figure 5:
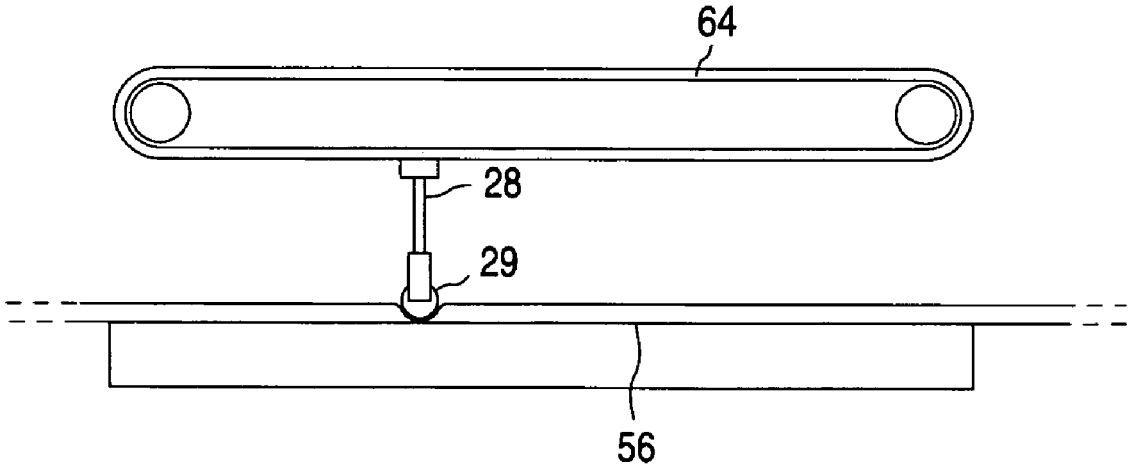
FIG. 5 is a side view of a third alternate embodiment of the present invention.

It is to be understood that the present invention is not limited to the embodiment(s) described above and illustrated herein, but encompasses any and all variations falling within the scope of the appended claims. For example, while pump housing portions 20*a*/20*b* are shown hingedly attached, they could instead snap together in the manner shown for cassette housing portions 46*a*/46*b*, and vice versa. Arm 28 need not necessarily be spring loaded. Compression surface 56 need not be circular, so long as the spring loaded roller arm 28 can maintain a desired minimal force for compressing compression tube 60. For example, the compression surface could be elliptical, where the rotating spring loaded roller arm has enough longitudinal travel (along the length of arm 28) to maintain contact with the compression tube 60 with sufficient force during the arm's revolution, as illustrated in FIG. 3. Alternately, the amount of longitudinal travel of the rotating arm could be more limited, where the roller 29 ceases compression of, and even possibly loses contact with, the compression tube at multiple points through its revolution, as illustrated in FIG. 4. In this case, the roller 29 twice loses contact with the compression tube 60, so that the pump produces two separate pulses of fluid flow per full revolution of the arm 28. In fact, roller 29 need not rotate about a fixed point, but can include translational movement, as shown in FIG. 5. In this embodiment, spring loaded arm 28 is connected to a moving conveyor belt or track 64 that moves roller 29 along a planar compression surface 56. One or more additional roller arms 28 (with rollers 29) can be added to belt/track 64, so long as only one roller is engaged with compression tube 60 at any given time.

What is claimed is:

1. A pump comprising:

a pump assembly that includes:

a pump housing that defines a cavity, a roller disposed in the cavity, and a motor for moving the roller relative to the housing;

a cassette assembly removably disposed in the cavity and including:

a cassette housing having a compression surface, and a hollow compression tube secured to the compression surface;

wherein as the motor moves the roller, the roller presses the compression tube against the compression surface to create a moving occlusion of the compression tube for pushing fluid through the compression tube;

wherein a channel is formed in the compression surface, the hollow compression tube includes a flange extending along a length thereof, and the flange is removably engaged with the channel for securing the compression tube to the compression surface;

wherein the cassette housing includes:

a lower cassette housing portion;

an upper cassette housing portion removably attached to the lower cassette housing portion.

2. The pump of claim 1, wherein:

the lower cassette housing portion includes an annular sidewall and a shoulder extending from the annular sidewall;

the upper cassette housing portion includes an annular sidewall; and the annular sidewalls of the lower and upper cassette housing portions mate together to form the compression surface, where upper cassette housing portion sidewall is positioned a fixed distance away from the shoulder to define the channel.

3. The pump of claim 1, wherein:

one of the lower and upper cassette housing portions includes tabs for engaging the other of the lower and upper cassette housing portions.

* * * * *